US006964400B2

(12) United States Patent
Lu

(10) Patent No.: US 6,964,400 B2
(45) Date of Patent: Nov. 15, 2005

(54) HANGING DEVICE FOR SUITCASE

(76) Inventor: Line-Ching Lu, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/826,935

(22) Filed: Apr. 16, 2004

(65) Prior Publication Data

US 2005/0230588 A1 Oct. 20, 2005

(51) Int. Cl.[7] ..... A47G 1/00; A44B 11/25

(52) U.S. Cl. ..... 248/316.5; 248/231.51; 403/385; 24/270

(58) Field of Search ..... 248/316.5, 689, 248/230.2, 229.13, 229.14, 229.23, 229.24, 248/229.11, 229.21, 230.1, 230.4, 230.5, 248/231.31, 231.51, 231.61; 403/385, 400, 403/396; 24/270; 285/373, 364, 365

(56) References Cited

U.S. PATENT DOCUMENTS 1,912,114 A * 5/1933 Allen ..... 24/270
2,029,707 A * 2/1936 Fred ..... 248/313
3,705,737 A * 12/1972 Westerlund et al. ..... 285/365
4,483,556 A * 11/1984 LiVolsi ..... 285/252
4,987,952 A * 1/1991 Beal et al. ..... 165/225
5,098,054 A * 3/1992 Dyer ..... 248/313
5,259,690 A * 11/1993 Legge ..... 403/385
5,305,978 A * 4/1994 Current ..... 248/230.4
5,742,982 A * 4/1998 Dodd et al. ..... 24/16 R
6,059,245 A * 5/2000 Hermansen et al. ..... 248/311.2
6,152,412 A * 11/2000 Basickes et al. ..... 248/317
6,633,749 B2 * 10/2003 Kubo et al. ..... 455/90.3
6,793,186 B2 * 9/2004 Pedersen ..... 248/229.13
2002/0175253 A1 * 11/2002 Sher ..... 248/231.51

* cited by examiner

*Primary Examiner*—Anita M. King
(74) *Attorney, Agent, or Firm*—Alan D. Kamrath; Nikolai & Mersereau, P.A.

(57) ABSTRACT

A hanging device for a suitcase includes a main body, a clamping plate pivotally mounted on the main body, a receiving chamber formed between the main body and the clamping plate, and a press plate pivotally mounted on the main body and locked on the clamping plate to fix the clamping plate on the main body. Thus, the hanging device is mounted on the retractable handle of the suitcase to hang a bag (briefcase or portfolio) that is placed on the top of the suitcase and is supported by the protruding flange of the main body, thereby facilitating a user carrying the bag and the suitcase simultaneously.

6 Claims, 7 Drawing Sheets

PRIRO ART

PRIRO ART

HANGING DEVICE FOR SUITCASE

BACKGROUND OF THE INVENTION

1. Field of the Invention

The present invention relates to a hanging device for a suitcase, and more particularly to a hanging device that is mounted on the retractable handle of the suitcase to hang a bag (briefcase or portfolio) that is placed on the top of the suitcase and is supported by the protruding flange of the main body, thereby facilitating a user carrying the bag and the suitcase simultaneously.

2. Description of the Related Art

A conventional suitcase in accordance with the prior art shown in FIG. 6 comprises a case body 1, two rollers 13 rotatably mounted on the case body 1, two pull handles 11 retractably mounted on the case body 1, and a handgrip 12 mounted on the two pull handles 11. However, the conventional suitcase cannot be used to support a bag (briefcase or portfolio), thereby causing inconvenience to a user when carrying the conventional suitcase and the bag simultaneously.

Another conventional suitcase in accordance with the prior art shown in FIG. 7 comprises a case body 2, a pull handle 21 retractably mounted on the case body 2, and a handgrip 22 pivotally mounted on the pull handle 21. However, the conventional suitcase cannot be used to support a bag (briefcase or portfolio), thereby causing inconvenience to a user when carrying the conventional suitcase and the bag simultaneously.

SUMMARY OF THE INVENTION

The primary objective of the present invention is to provide a hanging device that is mounted on the retractable handle of the suitcase to hang a bag (briefcase or portfolio) that is placed on the top of the suitcase and is supported by the protruding flange of the main body, thereby facilitating a user carrying the bag and the suitcase simultaneously.

Another objective of the present invention is to provide a hanging device that is adjustably mounted on the retractable handle of the suitcase, thereby the user carrying bags of different sizes.

A further objective of the present invention is to provide a hanging device for a suitcase, wherein the retractable handle of the suitcase is locked by the main body and the clamping plate, so that the hanging device is mounted on the retractable handle of the suitcase rigidly and stably.

A further objective of the present invention is to provide a hanging device for a suitcase, wherein the anti-skid pads provides an anti-skid effect to the main body and the clamping plate to prevent the hanging device from slipping from the retractable handle of the suitcase.

A further objective of the present invention is to provide a hanging device for a suitcase, wherein the noise suppression pad eliminates the noise produced by hit of the press portion of the press plate with the clamping plate.

In accordance with the present invention, there is provided a hanging device, comprising:

- a main body;
- a clamping plate pivotally mounted on the main body;
- a receiving chamber formed between the main body and the clamping plate; and
- a press plate pivotally mounted on the main body and locked on the clamping plate to fix the clamping plate on the main body.

Further benefits and advantages of the present invention will become apparent after a careful reading of the detailed description with appropriate reference to the accompanying drawings.

DETAILED DESCRIPTION OF THE INVENTION

Figure 1:
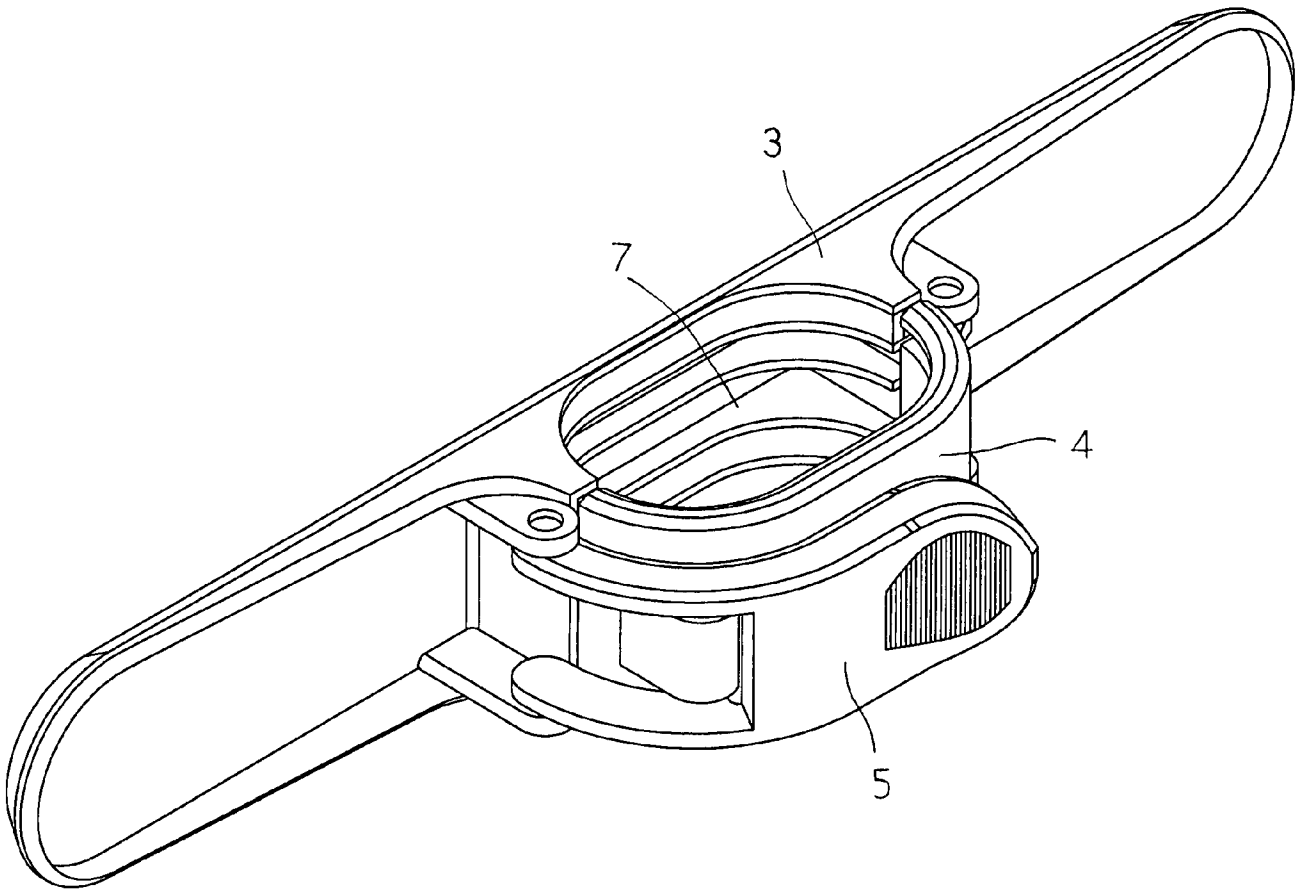
FIG. 1 is a perspective view of a hanging device in accordance with the preferred embodiment of the present invention.
Figure 2:
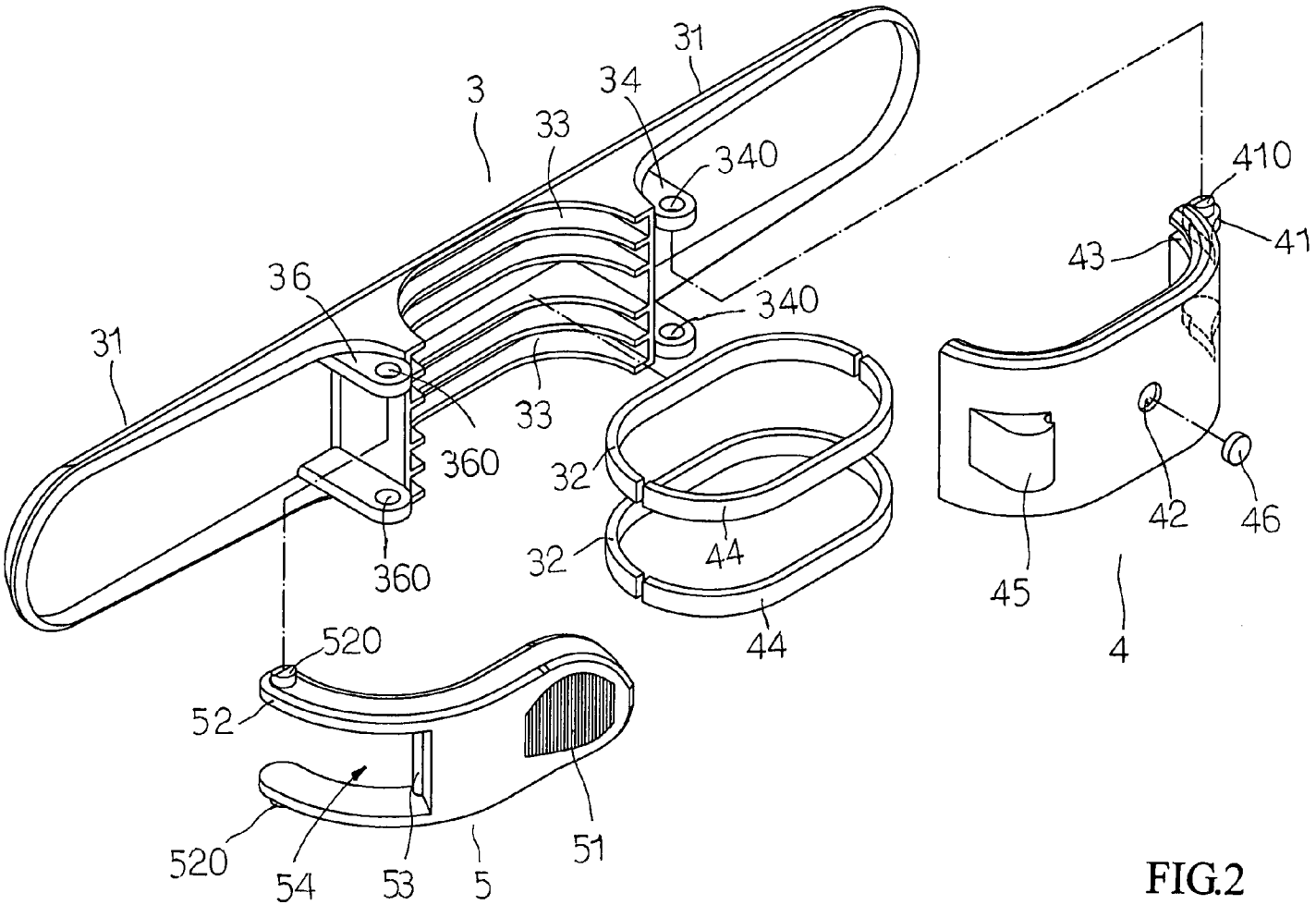
FIG. 2 is an exploded perspective view of the hanging device as shown in FIG. 1.
Figure 3:
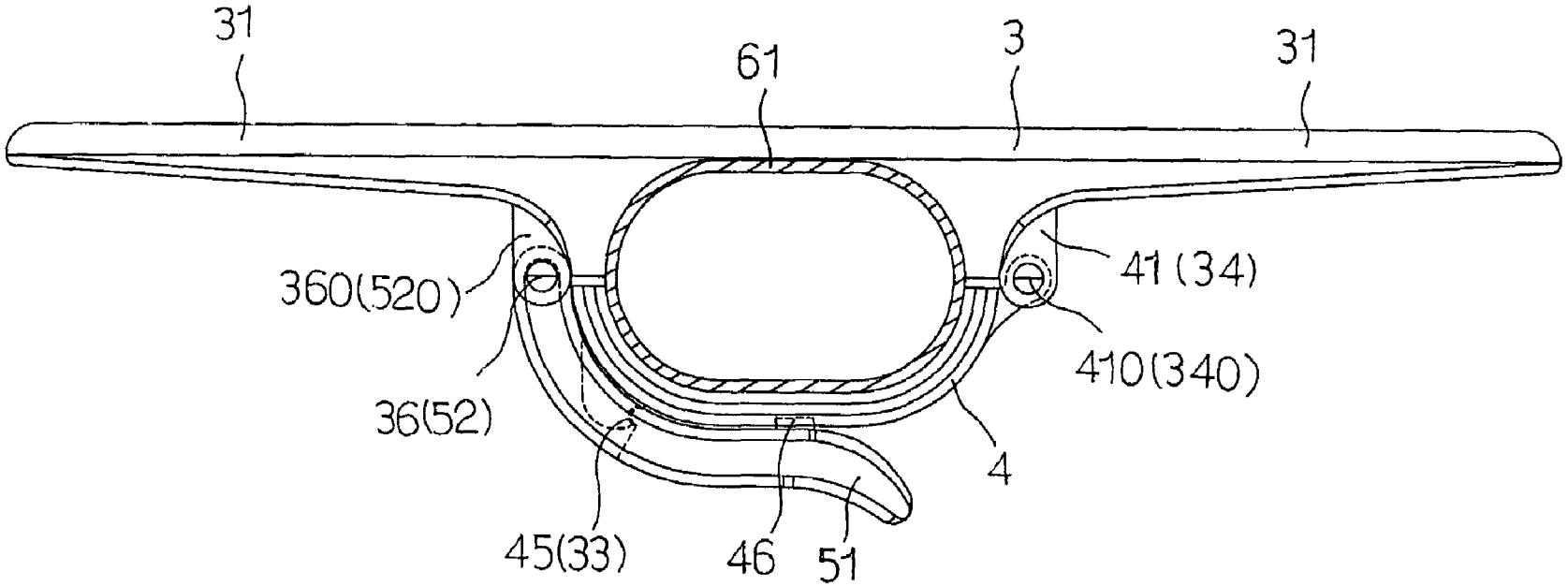
FIG. 3 is a top plan view of the hanging device as shown in FIG. 1.

Referring to the drawings and initially to FIGS. 1–3, a hanging device for a suitcase 6 (see FIG. 5) in accordance with the preferred embodiment of the present invention comprises a main body 3, a clamping plate 4 pivotally mounted on the main body 3, a receiving chamber 7 formed between the main body 3 and the clamping plate 4, and a press plate 5 pivotally mounted on the main body 3 and locked on the clamping plate 4 to fix the clamping plate 4 on the main body 3.

The main body 3 has two sides each formed with a protruding flange 31. The main body 3 has an inside formed with a plurality of receiving grooves 33 for mounting a plurality of anti-skid pads 32. The main body 3 has a first end formed with two spaced pivot bases 34 each formed with a pivot hole 340 and a second end formed with two spaced pivot seats 36 each formed with a pivot hole 360.

The clamping plate 4 has an inside formed with a plurality of receiving grooves 43 for mounting a plurality of anti-skid pads 44. The clamping plate 4 has a first end formed with two spaced pivot ears 41 each pivotally mounted on a respective one of the two spaced pivot bases 34 of the main body 3 and each formed with a wedge-shaped locking stub 410 pivotally mounted in the pivot hole 340 of the respective pivot base 34 of the main body 3. The clamping plate 4 has a mediate portion formed with a blind hole 42 for mounting a noise suppression pad 46 and a second end rested on the second end of the main body 3 and formed with a locking hook 45.

The press plate 5 has a first end formed with two spaced pivot ears 52 each pivotally mounted on a respective one of the two spaced pivot seats 36 of the main body 3 and each formed with a wedge-shaped locking stub 520 pivotally mounted in the pivot hole 360 of the respective pivot seat 36 of the main body 3. The press plate 5 has a mediate portion mounted on the locking hook 45 of the clamping plate 4 and formed with a locking groove 53 for locking the locking hook 45 of the clamping plate 4. Preferably, the mediate portion of the press plate 5 is formed with an opening 54 communicating with the locking groove 53 for receiving the locking hook 45 of the clamping plate 4. The press plate 5 has a second end formed with a press portion 51 rested on the mediate portion of the clamping plate 4 and located adjacent to the noise suppression pad 46.

Figure 4:
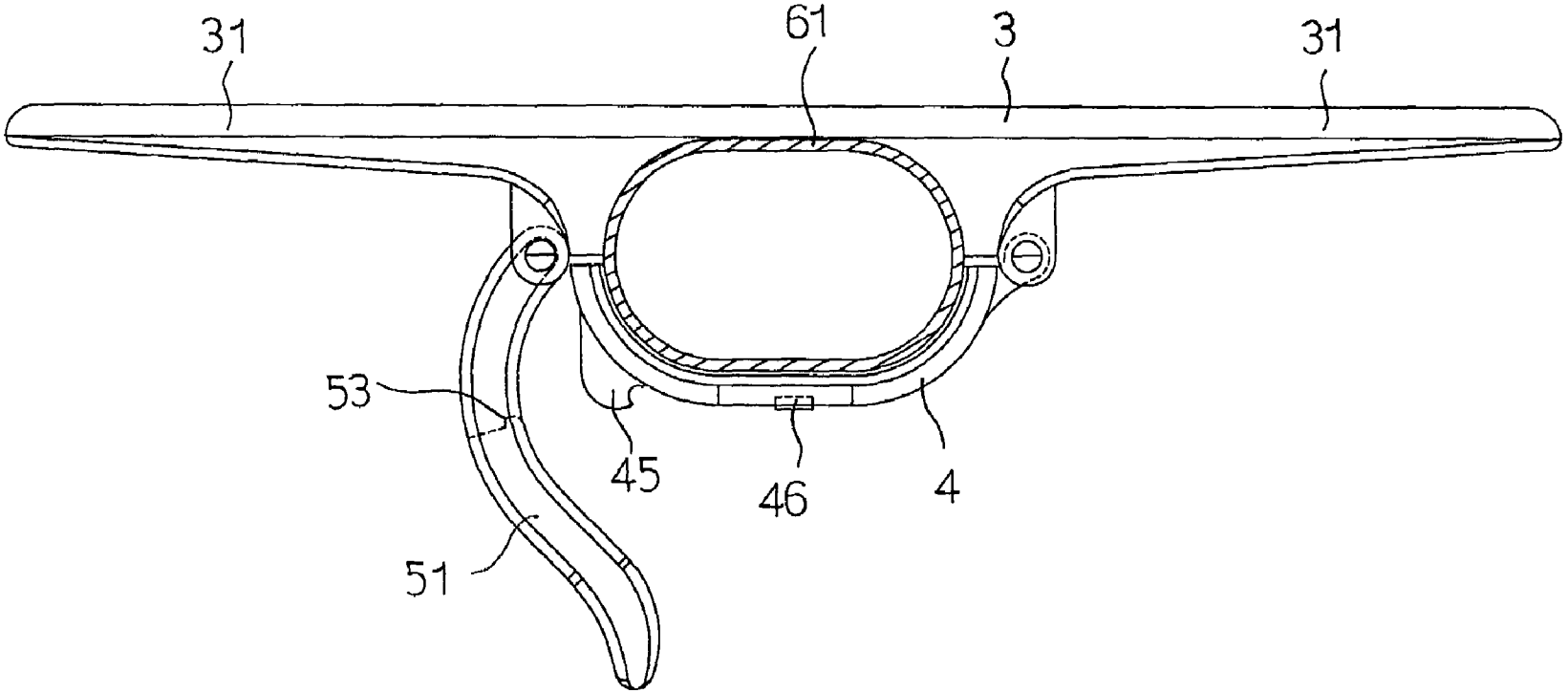
FIG. 4 is a schematic operational view of the hanging device as shown in FIG. 3.
Figure 5:
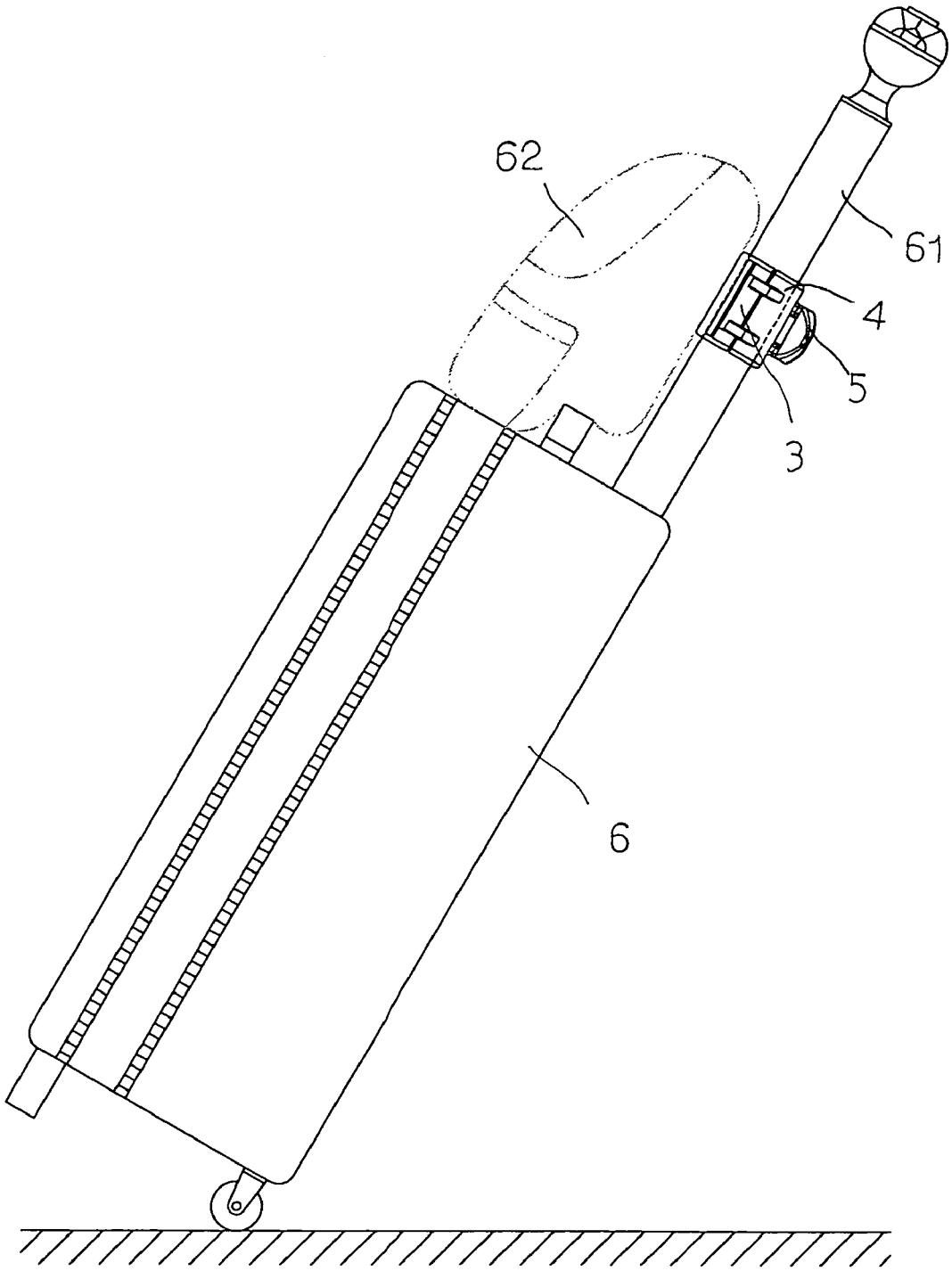
FIG. 5 is a plan view showing the hanging device being mounted on a suitcase.
Figure 6:
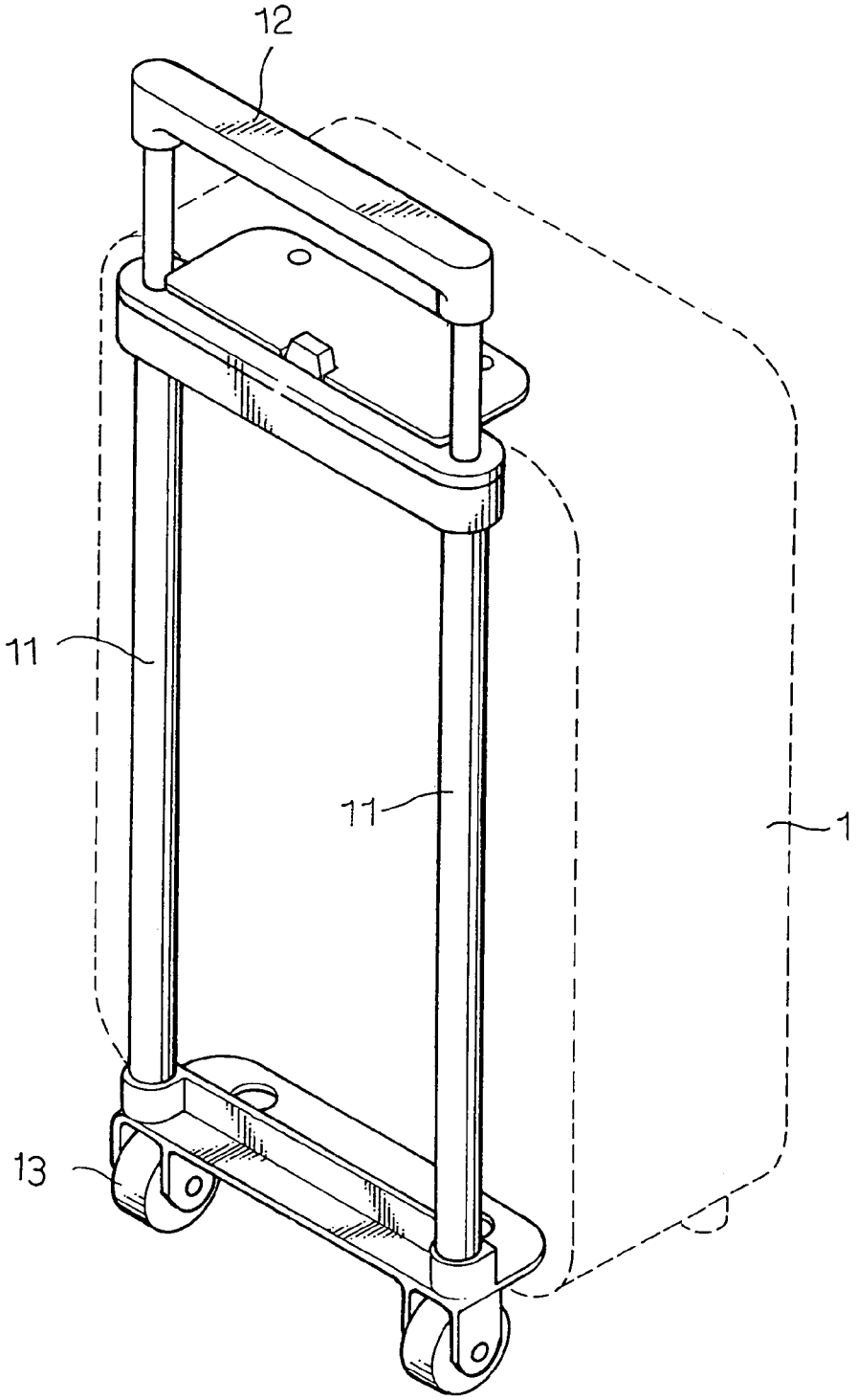
FIG. 6 is a perspective view of a conventional suitcase in accordance with the prior art.
Figure 7:
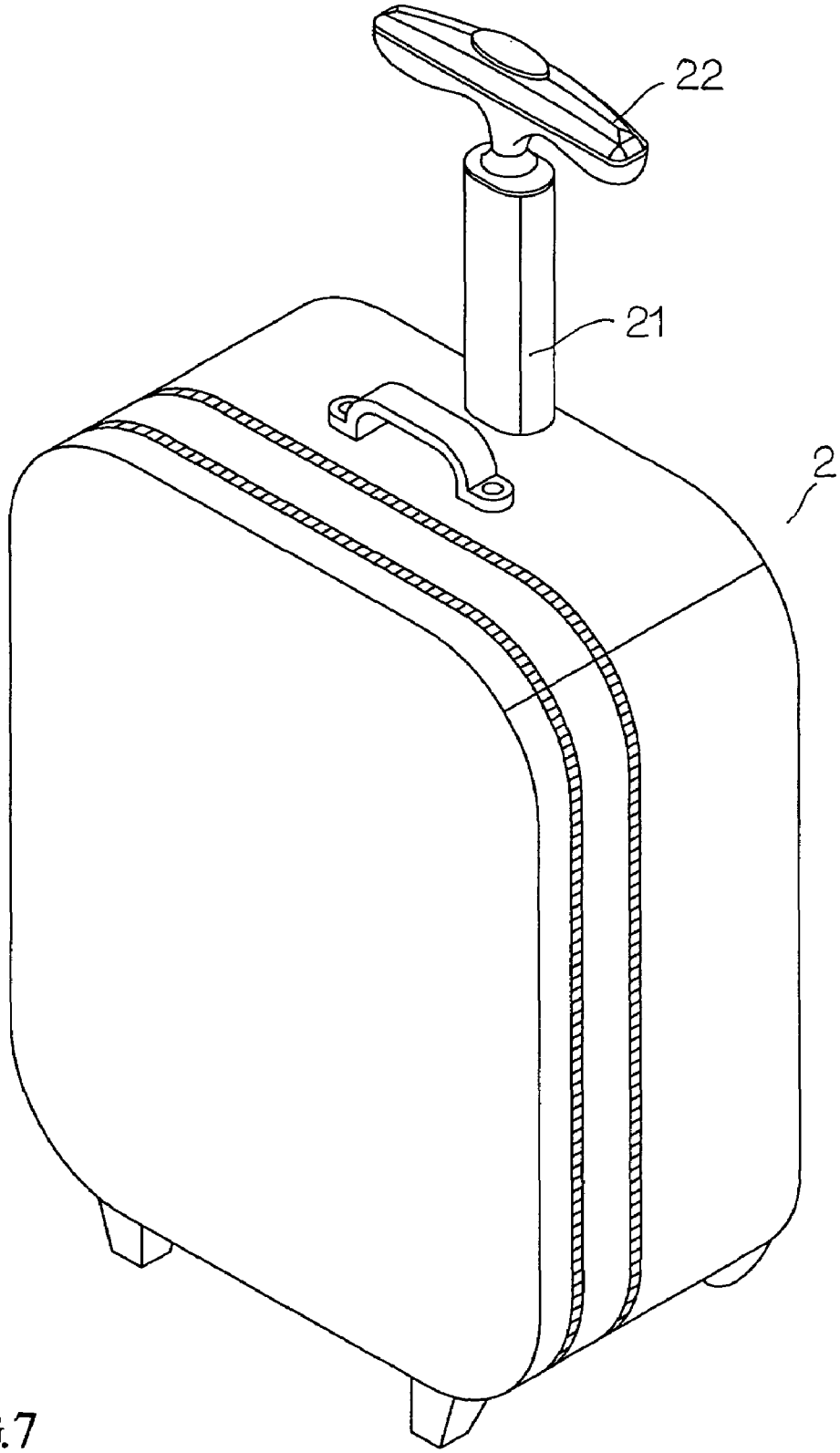
FIG. 7 is a perspective view of another conventional suitcase in accordance with the prior art.

In practice, referring to FIGS. 1–5, the hanging device is mounted on a retractable handle 61 of the suitcase 6. The retractable handle 61 of the suitcase 6 is mounted in the receiving chamber 7 formed between the main body 3 and the clamping plate 4 as shown in FIG. 3. At this time, the locking hook 45 of the clamping plate 4 is locked in the locking groove 53 of the press plate 5 and the press portion 51 of the press plate 5 is urged on the mediate portion of the clamping plate 4, so that the clamping plate 4 is locked by the press plate 5 to press the retractable handle 61 of the suitcase 6. Thus, the retractable handle 61 of the suitcase 6 is locked by the main body 3 and the clamping plate 4, so that the hanging device is mounted on the retractable handle 61 of the suitcase 6 rigidly and stably as shown in FIG. 5. In addition, the anti-skid pads 32 and 44 provides an anti-skid effect to the main body 3 and the clamping plate 4 to prevent the hanging device from slipping from the retractable handle 61 of the suitcase 6. Further, the noise suppression pad 46 eliminates the noise produced by hit of the press portion 51 of the press plate 5 with the clamping plate 4. In such a manner, a bag (briefcase or portfolio) 62 is placed on the top of the suitcase 6 and is supported by the protruding flange 31 of the main body 3, thereby facilitating a user carrying the bag 62 and the suitcase 6. In addition, the hanging device is adjustably mounted on the retractable handle 61 of the suitcase 6, thereby facilitating placement of the bag 62.

When not in use, the press plate 5 is pivoted outward to detach the locking hook 45 of the clamping plate 4 from the locking groove 53 of the press plate 5 as shown in FIG. 4, so that the clamping plate 4 can be pivoted outward to detach the retractable handle 61 of the suitcase 6 from the clamping plate 4, thereby detaching the hanging device from the retractable handle 61 of the suitcase 6. Thus, the hanging device can be removed from the retractable handle 61 of the suitcase 6 and placed into the suitcase 6 when not in use.

Accordingly, the hanging device is mounted on the retractable handle 61 of the suitcase 6 to hang a bag (briefcase or portfolio) 62 that is placed on the top of the suitcase 6 and is supported by the protruding flange 31 of the main body 3, thereby facilitating a user carrying the bag 62 and the suitcase 6. In addition, the hanging device is adjustably mounted on the retractable handle 61 of the suitcase 6, thereby the user carrying bags 62 of different sizes. Further, the retractable handle 61 of the suitcase 6 is locked by the main body 3 and the clamping plate 4, so that the hanging device is mounted on the retractable handle 61 of the suitcase 6 rigidly and stably. Further, the anti-skid pads 32 and 44 provides an anti-skid effect to the main body 3 and the clamping plate 4 to prevent the hanging device from slipping from the retractable handle 61 of the suitcase 6. Further, the noise suppression pad 46 eliminates the noise produced by hit of the press portion 51 of the press plate 5 with the clamping plate 4.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A hanging device, comprising:

a main body;

a clamping plate pivotally mounted on the main body;

a receiving chamber formed between the main body and the clamping plate; and a press plate pivotally mounted on the main body and locked on the clamping plate to fix the clamping plate on the main body; wherein:

the main body has a first end formed with two spaced pivot bases each formed with a pivot hole;

the clamping plate has a first end formed with two spaced pivot ears each pivotally mounted on a respective one of the two spaced pivot bases of the main body and each formed with a wedge-shaped locking stub pivotally mounted in the pivot hole of the respective pivot base of the main body;

the main body has a second end formed with two spaced pivot seats each formed with a pivot hole;

the press plate has a first end formed with two spaced pivot ears each pivotally mounted on a respective one of the two spaced pivot seats of the main body and each formed with a wedge-shaped locking stub pivotally mounted in the pivot hole of the respective pivot seat of the main body;

the press plate has a second end formed with a press portion rested on a mediate portion of the clamping plate;

the mediate portion of the clamping plate is formed with a blind hole for mounting a noise suppression pad;

the press portion of the press plate is located adjacent to the noise suppression pad.

2. The hanging device in accordance with claim 1, wherein the main body has two sides each formed with a protruding flange.

3. The hanging device in accordance with claim 1, wherein the main body has an inside formed with a plurality of receiving grooves for mounting a plurality of anti-skid pads.

4. The hanging device in accordance with claim 1, wherein the clamping plate has an inside formed with a plurality of receiving grooves for mounting a plurality of anti-skid pads.

5. The hanging device in accordance with claim 1, wherein the clamping plate has a second end rested on the second end of the main body and formed with a locking hook, and the press plate has a mediate portion mounted on the locking hook of the clamping plate and formed with a locking groove for locking the locking hook of the clamping plate.

6. The hanging device in accordance with claim 5, wherein the mediate portion of the press plate is formed with an opening communicating with the locking groove for receiving the locking hook of the clamping plate.

* * * * *